United States Patent [19]

Lowery

[11] 4,384,635

[45] May 24, 1983

[54] CONTINUOUS CURVATURE NOISE SUPPRESSING COMPRESSOR HOUSING

[75] Inventor: David C. Lowery, Manchester, Mich.

[73] Assignee: Tecumseh Products Company, Tecumseh, Mich.

[21] Appl. No.: 158,573

[22] Filed: Jun. 11, 1980

[51] Int. Cl.[3] ..... F25D 19/00; H02K 5/24

[52] U.S. Cl. ..... 181/403; 181/202; 181/296; 62/296

[58] Field of Search ..... 181/200, 202, 403, 175, 181/198, 296; 62/296; 417/312, 372

[56] References Cited

U.S. PATENT DOCUMENTS 3,187,995 6/1965 Kjeldsen ..... 62/296
3,663,127 5/1972 Cheers ..... 417/372

FOREIGN PATENT DOCUMENTS 1008559 7/1962 United Kingdom .
1035834 4/1963 United Kingdom .

*Primary Examiner*—Benjamin R. Fuller
*Attorney, Agent, or Firm*—Albert L. Jeffers; Roger M. Rickert

[57] ABSTRACT

A hermetic compressor housing formed from sheet metal as two housing halves which when joined form a generally ellipsoidal inner surface having a maximum radius of curvature of about one order of magnitude greater than the minimum radius of curvature and deviating from the generally ellipsoidal shape only where necessary for supporting a compressor-motor assembly therein and for joining the housing halves is disclosed and provides a housing of relatively uniform rigidity to reduce the level of sounds radiated thereby. In one specific embodiment all of the audible natural resonant frequencies of the housing are above 3500 Hz.

10 Claims, 7 Drawing Figures

CONTINUOUS CURVATURE NOISE SUPPRESSING COMPRESSOR HOUSING

CROSS REFERENCE TO RELATED APPLICATIONS

This application is related to copending application Ser. No. 158,574 entitled Hermetic Compressor filed by Donald L. Kessler on even date herewith the entire disclosure of which is incorporated by reference herein.

BACKGROUND OF THE INVENTION

The present invention relates generally to hermetic arrangements of the type almost universally used in refrigeration type systems such as home refrigerators or freezers, air conditioners or heat pumps, water coolers and similar refrigeration type systems and, more particularly, to a hermetic compressor housing arrangement for such systems of improved shape.

Hermetic compressors are quite well known with the conventional arrangement being an electric motor-compressor assembly, which is sometimes referred to simply as a compressor, being resiliently mounted in a sealed housing with the appropriate refrigerant conduits passing through that housing and with suitable electrical connections also passing through the housing.

Known compressor housings are typically formed from sheet metal as two housing portions which are joined by welding along a parting plane to encase the compressor within the housing. The typical shape of such a compressor housing has been that of a right circular cylinder with dome-like top and bottom ends. U.S. Pat. No. 3,663,127 illustrates a compressor housing having a generally elliptical configuration in the parting plane of the housing halves but still a generally cylindrical (straight side wall portion) shape. This prior patented housing efficiently utilizes the space available; however, the side wall portions which are generally straight in one plane are not as rigid as might be desired and tend to have natural resonant frequencies which lie both in the audible range and in the range where during compressor operation exciting frequencies of sufficient magnitude to cause overall noisy operation are present. In addition to the 60 cycle exciting frequencies associated with the motor, other noises associated with the compressor operation are present within the housing and an increase in housing rigidity as well as an increase in any of the natural resonant frequencies of the housing will reduce the overall noise associated with operation of the refrigeration system. Sound insulation has been a typical technique employed for reducing the noise of operation of such systems and particularly with contoured housings which have uniform rigidity and are poor sound attenuators such sound insulation is about the only remedy. Such contoured housings are, of course, also somewhat difficult to manufacture but do save space within the refrigerating device.

A readily manufactured hermetic compressor housing which inherently tends to reduce noise while effectively utilizing available space would be highly desirable.

SUMMARY OF THE INVENTION

Among the several objects of the present invention may be noted the provision of a housing for a hermetic compressor arrangement which reduces the overall noise associated with such arrangements; the provision of a hermetic compressor housing according to the previous object having higher natural resonant frequencies than known prior art housings; the provision of a housing for a compressor characterized by its substantially discontinuity free curvature; the provision of a housing for a compressor having a generally maximized curvature; the provision of a compressor housing wherein all of the audible natural resonant frequencies of the housing are above 3500 Hz.; the provision of a housing for a compressor unit with a reduced overall radius of curvature; and the provision of a generally ellipsoidal compressor housing surface where the maximum and minimum radii of curvature differ from one another by not more than about 1 order of magnitude.

These as well as other objects and advantageous features of the present invention will be in part apparent and in part pointed out hereinafter.

In general an improved compressor housing for a hermetic compressor arrangement is formed as two housing halves which, when joined, form a generally ellipsoidal inner surface which provides a predetermined minimum clearance between the housing inner surface and the encased motor-compressor assembly as well as providing a predetermined minimum clearance between the housing exterior and proximal parts of the refrigeration type unit and within these predetermined clearances has a generally maximized continuous curvature.

Also in general and in one form of the invention the level of sounds radiated by hermetic compressor housing are reduced by determining the minimum clearances required between the housing interior and the internal compressor assembly as well as between the housing exterior and the compressor environment and shaping the housing subject to these determinations to maximize the curvature thereof. The curvature should be as nearly continuous as possible and the housing inner surface should be formed substantially symmetric about each of three mutually perpendicular axes with the radius of curvature not exceeding about 13 inches or being less than about 1 inch.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 2:
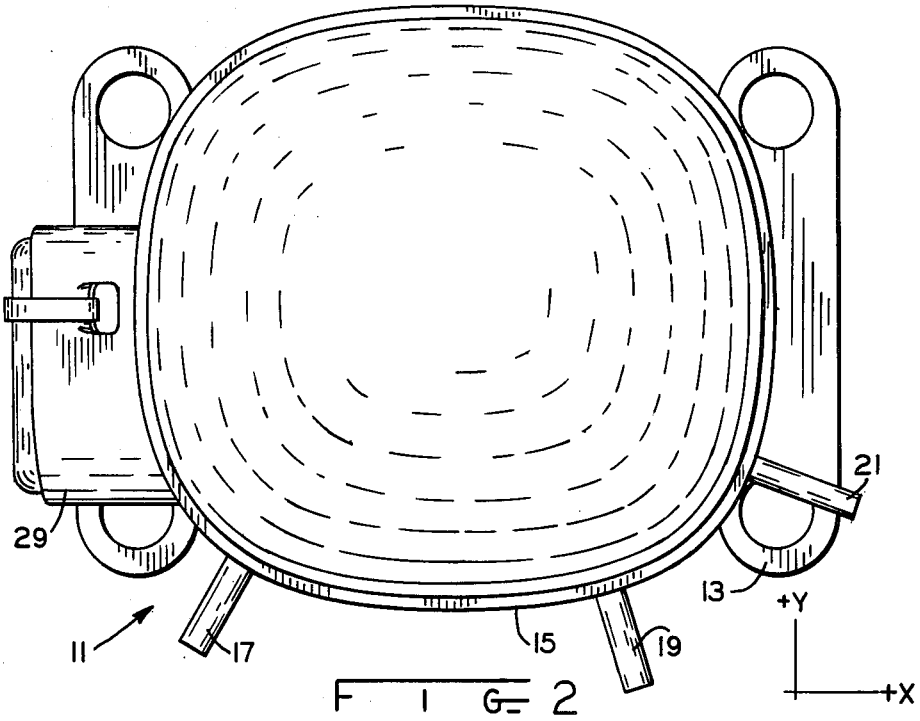
FIG. 2 is a top view of the hermetic compressor arrangement of FIG. 1 with the top half of the housing and the motor-compressor assembly removed.
Figure 1:
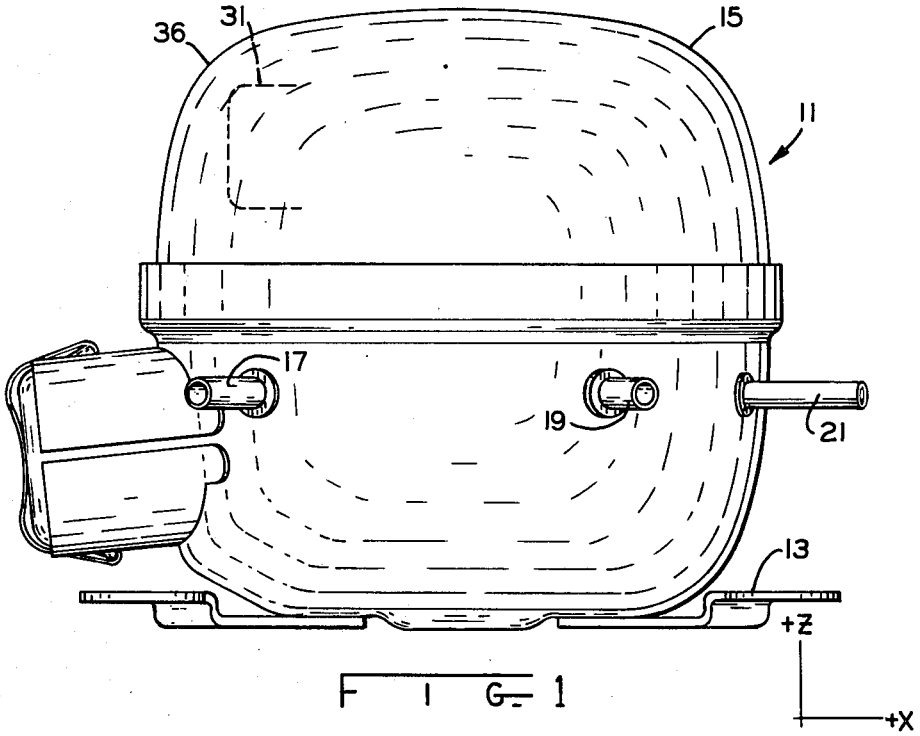
FIG. 1 is a side elevation view of a hermetic compressor arrangement according to the present invention.
Figure 3:
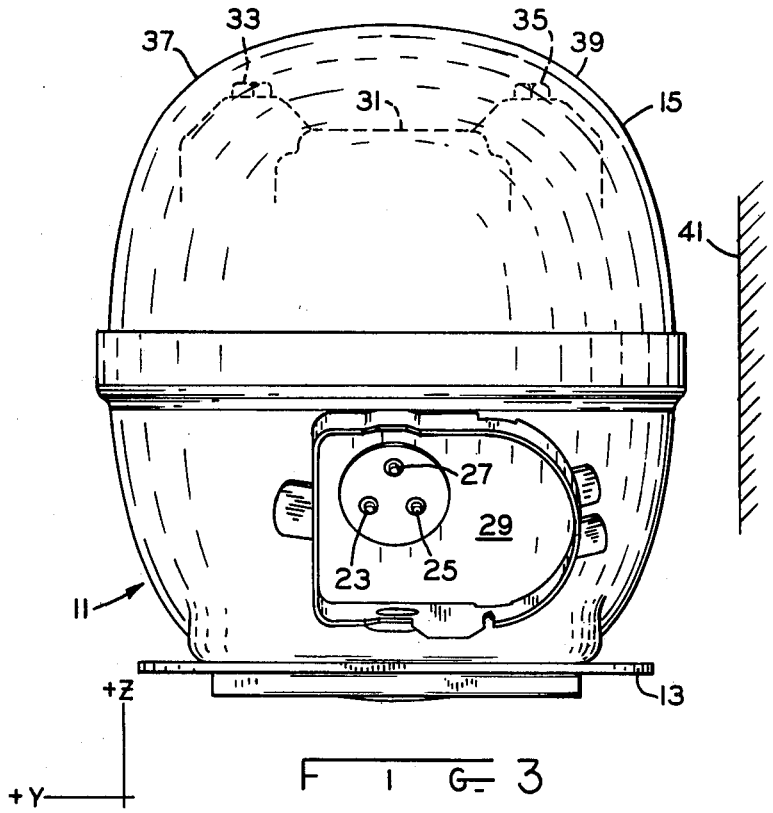
FIG. 3 is a side elevation view from the left of FIG. 1 and also illustrating a proximal part such as a side wall of a refrigeration type unit.

Referring first to the conventional aspects of FIGS. 1–3, the hermetic compressor 11 has a mounting plate or base 13 which will typically be spring-mounted within the intended environment of a refrigeration type system. The housing 15, the unique aspects of which will be described subsequently, has passing therethrough refrigerant connections such as 17, 19 and 21 which may be compressor inlet or outlet tubes or tubes for charging the unit with refrigerant as is conventional in the art. Also passing through the housing 15 will be the necessary wiring for supplying power to and controlling the electric motor within the housing. This wiring may be connected to terminals or prongs 23, 25 and 27 to which a plug may be connected for completing the wiring of the refrigeration type system. The electrical connections may include relays or other control circuitry in, for example, the exterior housing 29. Housing 15 will, of course, encase a motor-compressor assembly of any desired design and typically this motor-compressor assembly will be resiliently mounted to the bottom of the housing, for example, by shock mounting on a series of coil springs. This motor-compressor assembly, which may be of the type shown in the aforementioned copending application, is only partially illustrated in FIGS. 1 and 3 by dotted lines and may include a compressor cylinder head 31 and hexagonal heads 33 and 35 of bolts passing through the motor compressor assembly. These parts of the compressor may present clearance problems, for example, the compressor head is relatively close to region 36 of housing 15 as illustrated in FIG. 1 while the hexagonal bolt heads 33 and 35 are relatively close to points 37 and 39 of housing 15 as illustrated in FIG. 3. These compressor parts have been identified for illustration purposes only since the compressor parts causing minimum clearance difficulties will differ from compressor to compressor. Also exterior clearance problems may occur as illustrated in FIG. 3 where the housing 15 is positioned in its intended environment relatively close to wall 41 of the refrigeration type unit. Of course, other proximal parts of the unit might constitute the minimum exterior clearance dimension problem.

It is clear then that a hermetic compressor housing must both clear the internal compressor assembly so that it does not hit the housing during normal operation and fit inside a given space in the intended application. These considerations comprise both inside and outside constraints on the geometric design of the housing within which an endless number of solutions are possible. As noted earlier previous solutions have relied on combinations of sections of cylinders, and flat plates connected so as to form the housing surface sometimes using blend radii to connect the various sections. This previous solution typically results in points and lines where the curvature is discontinuous. The acoustically superior design is to choose a housing geometry where there are no discontinuities in the curvature of the surface with the attendant advantage of increased stiffness and a decreased maximum stress due to the elimination of the discontinuities in that curvature. This approach has the additional advantage that the extra stiffness of the housing reduces radiated sound levels. The ideal housing then would have uniform rigidity, be stress free, occupy a minimal space, have excellent sound attenuation and be easy to manufacture.

As noted earlier discontinuities in the housing curvature or its reciprocal, the radius of the curvature, result in stress concentrations and the elimination of these discontinuities will provide a stronger housing as well as raising the resonant frequencies of that housing to levels where there is less energy from the typical compressor assembly to excite the housing at these higher frequencies and therefore the overall noise of the system may be reduced.

Figure 5:
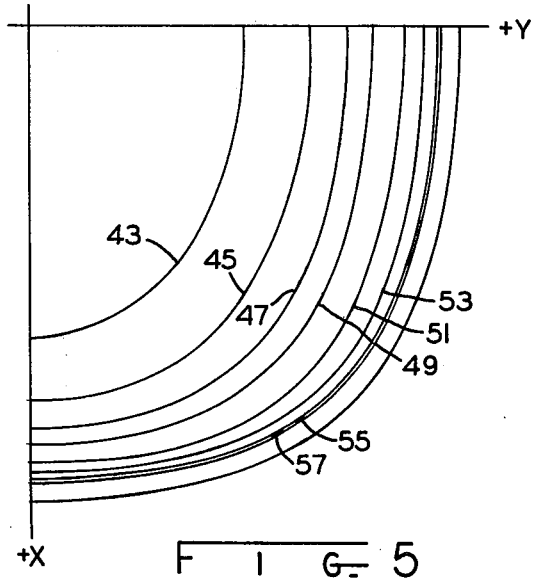
FIGS. 5, 6 and 7 illustrate the curvature of the inner housing surface in planes normal to each of the three coordinate axes.
Figure 6:
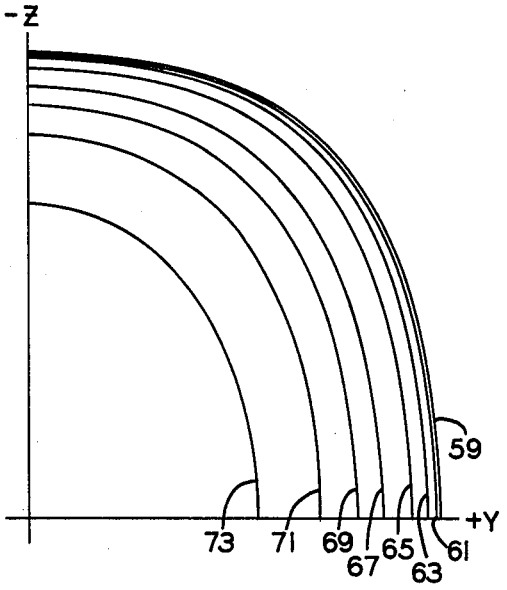
Figure 7:
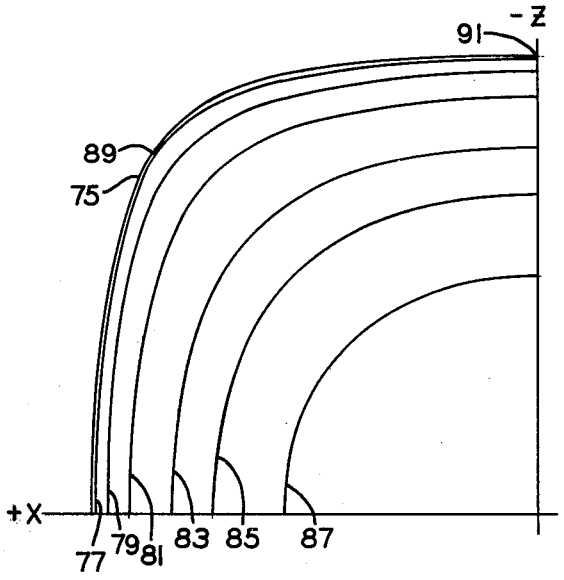

These goals are accomplished in the present invention by providing a elliptical housing inner surface that is symmetric about each of three mutually perpendicular coordinate axes which surface is not, however, typically a surface of revolution about those or any other axis. The techniques of the present invention do, however, produce a housing inner surface symmetric about each of the axes. Referring, for example, to FIGS. 5, 6 and 7 the curve configuration in each adjacent quadrant will be the mirror image of the illustrated curve in the axis separating those quandrants.

Thus, the level of sounds radiated by hermetic compressor housings are reduced according to the techniques of the present invention by determining the minimum clearance required between housing interior and the internal compressor assembly. This might, for example, be the distance between point 36 on the housing and the corner of the compressor head 31 as illustrated in FIG. 1 or the distance between hexagonal bolthead 35 and point 39 on the housing or may be at any of several other locations on the compressor assembly. The value of the minimum clearance will depend upon many factors including how stiffly the compressor is mounted within the housing as well as the expected level of vibrations and shock that the compressor may experience in normal use. A similar determination of the minimum clearance required between the housing exterior and the compressor environment such as refrigerator wall 41 in FIG. 3 will place a fair number of constraints or limitations on the housing shape and, subject to these determined minimum clearances, the housing is shaped according to the present invention to maximize the curvature thereof. In some instances this maximization of curvature could result in a spherical housing; however, often there will be additional constraints and other consideration which will preclude a spherical housing configuration. There may further be upper and lower bounds on the radius of curvature, for example, one specific housing to be discussed in greater detail subsequently had limitations that the radius of curvature not exceed about 13 inches nor be less than about 1 inch and these constraints for a particular installation resulted in a housing inner surface of a generally ellipsoidal shape which was defined generally in Cartesian coordinate form by:

$$528x^2+19.6x^4+0.558x^8+1322y^2+709Z^2+0.990Z^6+0.463Z^8=10{,}000.$$

Figure 4:
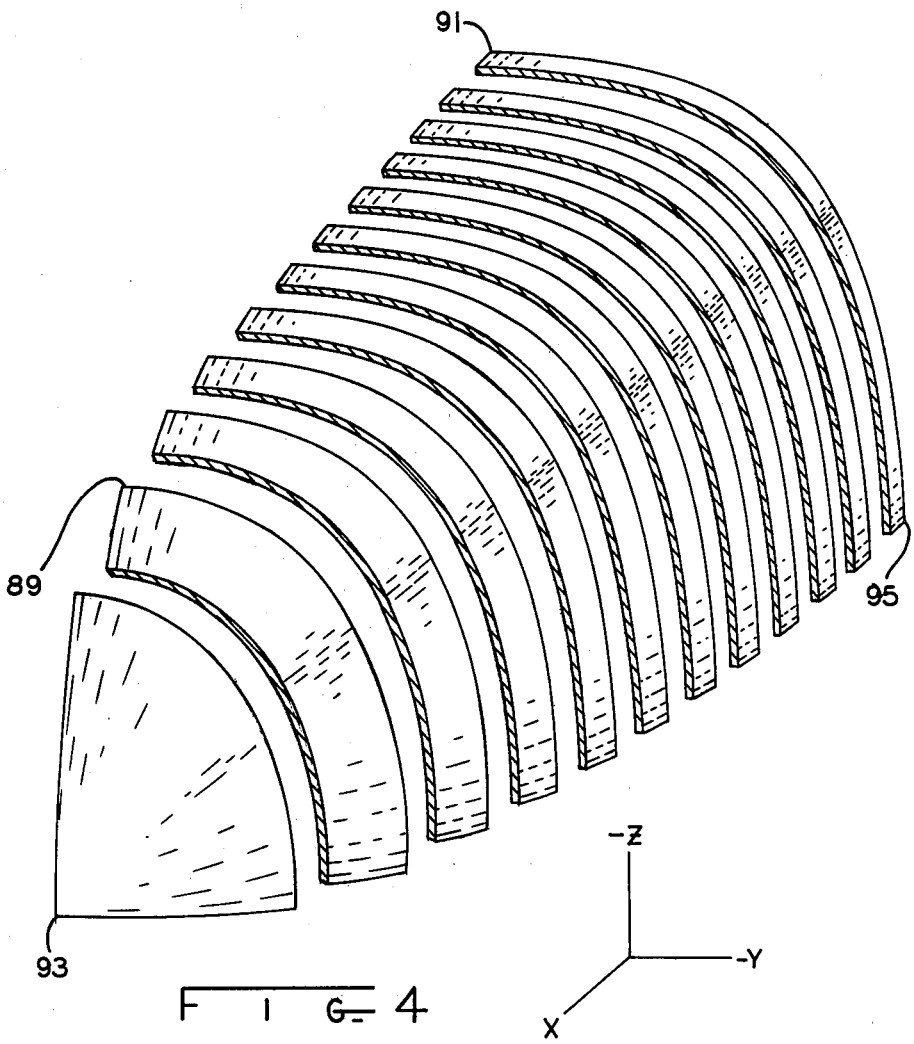
FIG. 4 is a perspective view of the lower right front of the housing as viewed in FIG. 1 with that octant sliced and exploded at uniform intervals to better illustrate the curvature thereof.

The foregoing equation represents one specific embodiment designed according to the techniques of the present invention for a relatively small compressor unit which for this example had no audible natural resonant frequencies below 4,000 Hz. The compressor unit was about 6 inches high, 6 inches wide and about 5 and ½ inches deep and is the specific exemplary compressor housing the interior surface shape of which is illustrated in FIGS. 5–7 and one octant of which is illustrated in FIG. 4 sliced about every one-quarter inch to better illustrate the actual shape thereof.

Referring specifically to FIG. 5 the curve 43 illustrates the inner surface shape of the housing in a plane parallel to the plane of the X, Y axis and with a value of Z of 2 and ¾ inches. Thus, this curve physically lies near the bottom of the housing as illustrated in FIG. 2 and in the lower right-hand corner thereof. Similarly, curve 45 is for a Z value of 2 and ½ while curve 47 has a Z value of 2 and ¼ and curve 49 has a value of Z=32 inches. Curves 51, 53 and 55 are respectively for Z values of 1.5, 1, and ½ inch while curve 57 which is nearly indistinguishable from curve 55 is the Z=0 curve or curve shape in the X, Y plane.

Similarly in FIG. 6 values of X of 0, ½ and 1 are respectively illustrated by curves 59, 61 and 63 while X values of 1 and ½, 2 and 2 and ¼ are illustrated by curves 65, 67 and 69 and curves 71 and 73 illustrate respectively the values of 2 and ½ and 2 and ¾.

Curve traces for the inner surface in planes parallel to the X, Z plane are illustrated in FIG. 7 and again values of Y=0 or ½ are nearly indistinguishable and identified as curves 75 and 77 respectively. A Y value of 1 corresponds to curve 79 while curves 81 and 83 illustrate Y values of 1.5 and 2 with curves 85 and 87 corresponding to Y values of 2 and ¼ and 2 and ½ respectively.

For this particular housing, FIG. 7 happens to also illustrate the points of maximum and minimum curvature. Thus the maximum curvature or minimum radius of curvature occurs at 89 where X and Z are both approximately 2.5 inches and the radius of curvature is approximately 1.2 inches. The maximum radius of curvature occurs at point 91 where X is 0 and Y is 0 while Z is attaining its maximum absolute value. This radius of curvature is about 12.84 inches with these maximum and minimum curvature points 89 and 91 also being identified in FIG. 4. Note that these maximum and minimum values of the radius of curvature (12.84 and 1 and ¼ inches) differ by about 1 order of magnitude.

The specific housing inner surface illustrated in FIGS. 5–7 have a maximum distance from the origin along the X axis of about 3 inches and similarly a maximum distance from the origin along the Z axis of about 3 inches while this distance in the Y direction is about 2 and ¾ inches and this concept of maximum distance when two of the three coordinate values are 0 may be used to generalize the earlier equation in a manner wholly independent of the units of measurement employed so as to define a whole class of housing configurations of substantially the same (similar) shape but of differing sizes by: $528\ S^6\ U^2+19.6\ S^4\ U^4+0.558\ U^8+1322\ S^6\ V^2+709\ S^6\ W^2+0.990\ S^2\ W^6+0.463\ W^8=10{,}000\ S^8$.

Here S is the scale factor and U, V and W replace X,Y, and Z as coordinates.

The concept of an equivalent spherical radius of curvature is also sometimes helpful in analyzing a particular housing configuration and in attempts to generally maximize the curvature thereof. Three axis intercepts 91, 93 and 95 are illustrated in FIG. 4. For example, at point 91 both X and Y are 0 while Z takes on its maximum absolute value. At this Z intercept 91, the radius of curvature of the housing inner surface in the X, Z plane may be determined and similarly the radius of curvature in the Y, Z plane may be determined. The equivalent spherical radius of curvature at this point then is the square root of the product of the two radii of curvature in the two corresponding coordinate planes. For the specific housing illustrated in FIGS. 4–7 the equivalent spherical radius of curvature at point 91 was 8.1 inches while at point 95 this equivalent value was 7.8 inches and at the X intercept 93 this equivalent spherical radius of curvature was 5.9 inches. These values being relatively close to one another indicate that a maximizing generally of the housing curvature has probably been achieved.

From the foregoing it is now apparent that a novel housing for a hermetic compressor arrangement as well as a novel approach for reducing the level of sounds radiated by a hermetic compressor housing have been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In a hermetic compressor arrangement for a refrigeration type system having a motor-compressor assembly encased and resiliently supported in a compressor housing of the type formed as housing halves with means joining those halves and with the compressor housing in turn mounted within a refrigeration type unit, an improved compressor housing formed from sheet metal to have a generally ellipsoidal inner surface and deviating therefrom where necessary for supporting a compressor therein and for joining the housing halves which when joined form a generally ellipsoidal inner surface having variable curvature in each plane therethrough and providing a predetermined minimum clearance between the housing inner surface and the encased motor-compressor assembly as well as a predetermined minimum clearance between the housing exterior and proximal parts of the refrigeration type unit, and within the limits of the predetermined clearances, the housing inner surface having a generally continuous curvature with the greatest and least radii of curvature thereof differing by about one order of magnitude to provide a housing of relatively uniform rigidity and to reduce the level of sounds radiated thereby, the housing inner surface being substantially symmetric about each of three mutually perpendicular axes U, V and W, and wherein the housing inner surface may generally be described by: $528\ S^6\ U^2+19.6\ S^4\ U^4+0.558\ U^8+1322\ S^6\ V^2+709\ S^6\ W^2+0.990\ S^2\ W^6+0.463\ W^8=10{,}000\ S^8$ where S is a size factor.

2. The improvement of claim 1 wherein the housing has audible natural resonant frequencies all of which are greater than 3500 hz.

3. The improvement of claim 1 wherein the maximum distance in the U and W directions is about 3 inches while in the V direction the maximum distance is about 2¾ inches.

4. The improvement of claim 1 wherein the equivalent spherical radii of curvature of the housing inner surface axis intercepts are about 5.9, 7.8, and 8.1 inches respectively.

5. The improvement of claim 1 wherein the radius of curvature of the inner surface is limited generally to values less than about 13 inches.

6. The improvement of claim 1 wherein the radius of curvature of the inner surface is limited generally to values greater than about 1 inch.

7. The method of reducing the level of sounds radiated by a hermetic compressor housing comprising the steps of:

determining the minimum clearance required between the housing interior and the internal compressor assembly;

determining the minimum clearance required between the housing exterior and the compressor environment; and shaping the housing subject to the foregoing determinations to maximize the curvature thereof and to avoid any discontinuities in that curvature, the housing being shaped as two housing halves which, when joined to encase the compressor assembly, form a generally ellipsoisal inner surface defined generally in Cartesian coordinate form by:

$$528X^2+19.6X^4+0.558X^8+1322Y^2+7092Z^2+0.990Z^6+0.463Z^8=10,000.$$

8. The method of claim 7 wherein the step of shaping is performed subject to the further constraint that the ratio of the maximum radius of curvature to the minimum radius of curvature of the housing interior surface is about ten.

9. The method of claim 7 including the additional step of generally limiting the radius of curvature of the housing inner surface to values less than about 13 inches.

10. The method of claim 7 including the additional step of generally limiting the radius of curvature of the housing inner surface to values greater than about 1 inch.

* * * * *